United States Patent [19]

Hashimura

[11] 4,268,618

[45] May 19, 1981

[54] BLEACHING COMPOSITION FOR PHOTOGRAPHIC PROCESSING

[75] Inventor: Taiji Hashimura, Minami-ashigara, Japan

[73] Assignee: Fuji Photo Film Co., Ltd., Minami-ashigara, Japan

[21] Appl. No.: 166,205

[22] Filed: Jul. 7, 1980

[30] Foreign Application Priority Data

Jul. 5, 1979 [JP] Japan ..... 54-85397

[51] Int. Cl.[3] ..... G03C 5/32

[52] U.S. Cl. ..... 430/393; 430/430; 430/460; 430/461

[58] Field of Search ..... 430/372, 393, 430, 431, 430/460, 461, 462, 427; 252/186, 187 R, 79.1, 79.2, 79.4

[56] References Cited

U.S. PATENT DOCUMENTS

| | | | |
|---|---|---|---|
| 3,772,020 | 11/1973 | Smith | 430/393 |
| 3,809,563 | 5/1974 | Nimura et al. | 430/460 |
| 3,820,997 | 6/1974 | Shirasu et al. | 430/393 |
| 3,879,202 | 4/1975 | Yamaguchi | 430/372 |
| 3,909,267 | 9/1975 | Iwano et al. | 430/372 |
| 3,948,659 | 4/1976 | Yamaguchi et al. | 430/393 |
| 3,997,348 | 12/1976 | Shimamura et al. | 430/372 |

FOREIGN PATENT DOCUMENTS

| | | | |
|---|---|---|---|
| 52-55531 | 7/1977 | Japan | 430/461 |

*Primary Examiner*—Mary F. Downey

*Attorney, Agent, or Firm*—Sughrue, Rothwell, Mion, Zinn and Macpeak

[57] ABSTRACT

A bleaching composition having strengthened oxidizing power and which markedly reduces color stains is described, which contains as essential components: (1) an organic acid-iron (III) complex salt; (2) an alkali metal or an ammonium salt of bromic acid; (3) a water-soluble halogenide; (4) at least one compound selected from the group consisting of the compounds having the formula (I) or (II)

(I)

(II)

wherein X represents COOM or an amino group, with M representing hydrogen, an alkali metal ion or ammonium ion; $R^1$ represents a divalent aliphatic group containing 1 to 4 carbon atoms which may be substituted with hydroxy groups, amino groups and/or carboxy group; n is 0 or 1; and $R^2$ and $R^3$ may be the same or different from each other, and each represents an amino group, an acylamino group, an alkyl group, an alkenyl group, a phenyl group, or a 5-membered or a 6-membered heterocyclic group, or $R^2$ and $R^3$ together form a 5-membered or a 6-membered ring; and (5) at least one compound selected from the group consisting of compounds represented by the formula (III)

(III)

wherein $R^4$ and $R^5$ may be the same or different from each other, and they each represents an alkyl group, an alkenyl group, a phenyl group, or a 5-membered or a 6-membered heterocyclic group, or $R^4$ and $R^5$ together form a 5- or a 6-membered ring.

28 Claims, No Drawings

BLEACHING COMPOSITION FOR PHOTOGRAPHIC PROCESSING

BACKGROUND OF THE INVENTION

1. Field of the Invention

This invention relates to a bleaching composition which is employed for processing silver halide color photographic light-sensitive materials and more particularly, to a bleaching composition containing as a bleaching agent a particular combination including an organic acid-iron (III) complex salt, a bromate salt, and a water-soluble halogenide.

2. Description of the Prior Art

In typical processes for photographic processing of a silver halide color photographic light-sensitive material, the light-sensitive material (i.e., the silver halide photographic emulsion, which may be fogged in advance of the photographic exposure) is exposed to an imagewise pattern of light, and then development-processed with a developing solution containing an aromatic primary amine developing agent in the presence of dye-forming couplers, to produce a color image and developed silver simultaneously. The developed silver thus produced is converted into a halide thereof again in the subsequent bleaching step, and then removed from the material by receiving a fixing or a bleaching-fixing treatment.

Hitherto, ferricyanates, dichromates, ferrates (III), organic acid-iron (III) complex salts, persulfates and so on have been known to be usable as bleaching agents in bleaching compositions to be employed in the bleaching step, while water-soluble halogenides such as sodium chloride, ammonium chloride, sodium bromide and the like have been known to be usable as rehalogenating agents therein. Of the above-described bleaching agents, ferricyanates are preferred from the viewpoint that they have bleaching rates (oxidizing rates) high enough to completely oxidize developed silver within a practically permissible period of time. However, a bleaching solution in which a ferricyanate is employed as a bleaching agent liberates cyan ion on photolysis, to cause an environmental pollution problem, and therefore some step(s) for transforming the used solution to a completely harmless form must be taken.

In the case of another bleaching solution in which a dichromate is used as the bleaching agent it is also necessary to take some step(s) for transforming the waste solution to a completely harmless form so that the waste solution does not discharge dichromic acid ion, which is harmful from the viewpoint of environmental concerns.

Compositions as described above, which require such additional treatments so as to render the wastes thereof completely harmless, suffer from the defect that practice of such measures in an industrial scale is complex and costly.

With the intention of overcoming the defects of ferricyanate and dichromate bleaching compositions, it has been attempted to employ inorganic ferrates (III), organic acid-iron (III) complex salts, persulfates, etc., as the bleaching agent.

Bleaching solutions containing inorganic ferrates (III) or persulfates not only cause environmental pollution problems, but also suffer from the disadvantage that they corrode materials of which the processing machine and tanks for processing solutions are typically constructed. In addition, persulfates are dangerous materials which are inconvenient to handle, since great care must be taken in storing and transporting them. Among bleaching agents that do not possess such disadvantages as described above are organic acid-iron (III) complex salts.

However, bleaching solutions in which organic acid-iron (III) complex salts are employed as the bleaching agent suffer from the disadvantages that they not only have insufficient bleaching power (because their oxidizing power is low), but also tend to cause poor color-development when used in the case of relatively short time processing of a color photosensitive material. This poor color-development is presumed to be caused by the incomplete oxidation of the reaction products of couplers produced by color development with the color developer in the bleaching step. Namely, the incomplete oxidation is believed to bring about such a situation wherein the reaction products remain mainly in a form of a colorless leuco dye, and, consequently, they are only partially converted to their respective ultimate dyes.

Though it is possible to convert these leuco dyes into their respective photographic dyes through oxidation even when the bleaching solution containing an organic acid-iron (III) complex salt is used, the bleaching processing using such a bleaching solution must be continued for a long time in order to achieve the complete conversion of the leuco dyes into the final color photographic dyes. However, it is very difficult to elongate the processing time for bleaching, since the photographic processing must necessarily be limited in time, for instance, in the case wherein the photographic processing is carried out using an automatic developing machine or the like.

On the other hand, addition of bromate ion in the form of alkali metal salt or ammonium salt to the bleaching solution containing an organic acid-iron (III) complex salt can prevent the occurrence of poor color-development by facilitating oxidation of leuco dyes within a period of time required usually for bleach to result in the conversion to photographic dyes. However, the use of such a bleaching solution causes new problems. One problem is the occurrence of stain due to a strengthening of the oxidizing power of the bleaching solution. Particularly, magenta stain and yellow stain are apt to be caused in light-sensitive materials by such a bleaching step. The other problem lies in the fact that the power of the bleaching solution decreases with the lapse of time because bromates are unstable in the bleaching solution, and therefore tend to decompose. This indicates that the bleaching solution to which a bromate is added has a short life. Consequently, not only does the regeneration of the bleaching solution for purposes of reuse thereof become difficult, but also it is necessary that fresh bleaching solution be added in a large amount as the processing proceeds. Accordingly, in the case where such a bleaching solution as described above is used, large amounts of reagents are required for the bleaching processing, thus resulting in the increased cost of processing, in other words, uneconomical processing.

SUMMARY OF THE INVENTION

Therefore, a first object of this invention is to provide a bleaching composition which does not cause an environmental pollution problem and that has a fast rate of bleaching.

A second object of this invention is to provide a bleaching composition in which the oxidizing power of the bleaching solution is strengthened without causing environmental pollution and stains.

A third object of this invention is to provide a bleaching composition which enables the bleaching power to be stably maintained in a state of aqueous solution by depressing the decomposition of bromate ion therein, thus enabling the regeneration of the bleaching solution.

A fourth object of the present invention is to provide a method for economically processing silver halide color photographic light-sensitive materials using the bleaching composition satisfying the above-described first to third objects.

The above-described objects are attained by use of a bleaching composition (also referred to as a bleaching solution) containing components (1), (2), (3), (4), and (5), which are defined as follows:

(1) an organic acid-iron (III) complex salt;

(2) an alkali metal or ammonium salt of bromic acid;

(3) a water-soluble halogenide;

(4) at least one compound selected from the group consisting of compounds having the following general formula (I) or (II)

$$X\text{-}(R^1)_n COOM \quad (I)$$

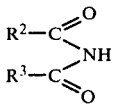

(II)

wherein X represents COOM or amino group, with M representing hydrogen, an alkali metal ion or ammonium ion; $R^1$ represents a divalent aliphatic group containing 1 to 4 carbon atoms which may be substituted with hydroxy groups, amino groups and/or carboxy groups; n is 0 or 1; and $R^2$ and $R^3$ may be the same or different from each other, and each represents an amino group, an acylamino group, an alkyl group, an alkenyl group, a phenyl group or a 5-membered or a 6-membered heterocyclic group, or $R^2$ and $R^3$ together form a 5-membered or a 6-membered ring; and (5) at least one compound selected from the group consisting of compounds having the formula (III)

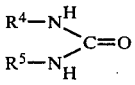

(III)

wherein $R^4$ and $R^5$ may be the same or different from each other, and each represents an alkyl group, an alkenyl group, a phenyl group or a 5-membered or a 6-membered heterocyclic group, or $R^4$ and $R^5$ form a 5-membered or a 6-membered ring.

DETAILED DESCRIPTION OF THE INVENTION

Preferred examples of compounds represented by the formula (I), which belongs to component (4), include oxalic acid, malonic acid, maleic acid, succinic acid, adipic acid, glycine, β-alanine, tartaric acid, citric acid and the like.

The alkyl groups and alkenyl groups represented by $R^2$ or $R^3$ in formula (II) are not limited to particular groups, but those which contain 1 to 4 carbon atoms are preferred as the alkyl groups, and those which contain 2 to 5 carbon atoms are preferred as the alkenyl groups.

Specific examples of preferred alkyl groups include a methyl group, an ethyl group, an isopropyl group and an n-butyl group. Specific examples of preferred alkenyl groups include a vinyl group, an allyl group and a butenyl group. Acylamino groups represented by $R^2$ or $R^3$ in the formula (II) are preferably those which contain 2 to 5 carbon atoms, with specific examples including an acetylamino group, a propionylamino group, a butyrylamino group, a valerylamino group and the like. The above-described alkyl groups, alkenyl groups and acylamino groups may be substituted with certain substituents, such as an amino group, a hydroxy group, a carboxy group or so on. Heterocyclic groups represented by $R^2$ or $R^3$ in the formula (II) preferably comprise 5-membered or 6-membered rings, with specific examples including a furyl group, a pyrrolyl group, a thiofuryl group, a pyrrolydyl group, an oxazolyl group, a thiazolyl group, an imidazolyl group, a pyridyl group, a piperidyl group, groups in each of which one of the above-described cyclic groups and a certain hydrocarbon ring are fused together by sharing two atoms; for example, a chromanyl group, an indolyl group, a thioindolyl group, a benzoxazolyl group, a benzothiazolyl group, a benzimidazolyl group, a quinolyl group, and so forth. The phenyl groups and the above-described heterocyclic groups (which may be fused together with hydrocarbon rings) which $R^2$ or $R^3$ represents can be substituted. Possible substituents include, preferably a hydroxyl group, an amino group, a carboxy group, alkyl groups containing from 1 to 4 carbon atoms, and alkoxy groups containing from 1 to 4 carbon atoms.

Heterocyclic nuclei formed by combining $R^2$ and $R^3$ can include, preferably, a maleinimido nucleus, a succinimido nucleus, an adipoimido nucleus, a hydantoin nucleus, and so forth. In addition, these heterocyclic nuclei may be fused together with 5-membered or 6-membered hydrocarbon rings, with specific examples including a phthalimido nucleus, a cyclohexanedicarboxyimido nucleus and so forth.

The above-described heterocyclic nuclei (which may be fused together with hydrocarbon rings), which may be formed by $R^2$ and $R^3$ together may have certain substituents. Examples of the preferred substituents include a hydroxy group, an amino group, a carboxy group, alkyl groups containing 1 to 4 carbon atoms and alkoxy groups containing 1 to 4 carbon atoms.

Alkyl groups, alkenyl groups, phenyl groups and heterocyclic groups which represent $R^4$ or $R^5$ in the formula (III) refers to the same types of alkyl groups, alkenyl groups, phenyl groups and heterocyclic groups, respectively, which are represented by $R^2$ or $R^3$ in the formula (II). In addition, heterocyclic nuclei formed by combining $R^4$ and $R^5$ include preferably 5-membered and 6-membered ones and specifically they are a 2-imidazolidinone nucleus, a uracil nucleus, a urazole nucleus, a 2,4,6-trioxypyrimidine nucleus and so forth.

Components (4) and (5) can each be effectively used in an amount of from about 0.005 to 0.5 mol, and more preferably in an amount from 0.01 to 0.3 mol, per liter of bleaching solution.

Specific examples of Component (4) which are preferably employed in the invention are illustrated below:

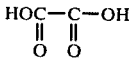
(4)-1
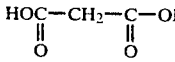
(4)-2
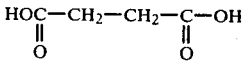
(4)-3
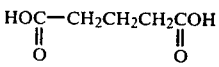
(4)-4
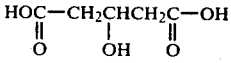
(4)-5
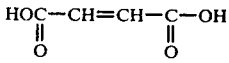
(4)-6
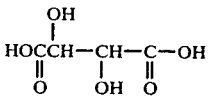
(4)-7
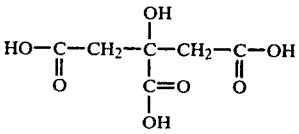
(4)-8
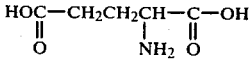
(4)-9
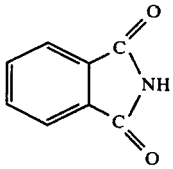
(4)-10
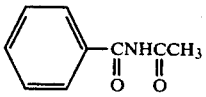
(4)-11
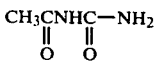
(4)-12
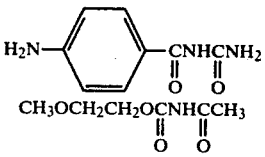
(4)-13
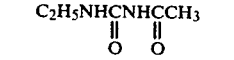
(4)-14
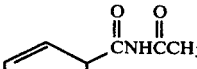
(4)-15
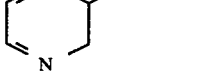
(4)-16
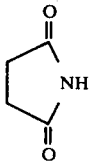
(4)-17
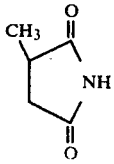
(4)-18
-continued
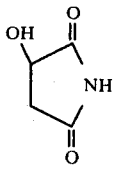
(4)-19
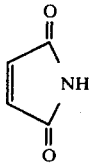
(4)-20
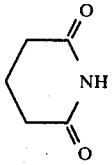
(4)-21
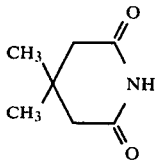
(4)-22
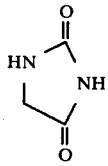
(4)-23
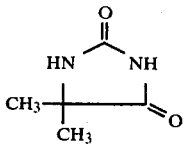
(4)-24
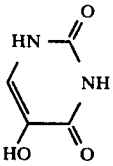
(4)-25
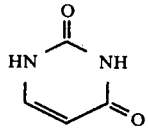
(4)-26
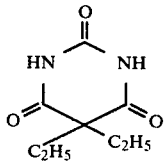
(4)-27
Specific examples of Component (5) which is preferably employed in the invention are illustrated below:
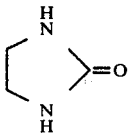
(5)-1

-continued (5)-2 $NH_2-C(=O)-NH_2$ (5)-3 $CH_2=CHCH_2NHC(=O)NHC_2H_5$ (5)-4 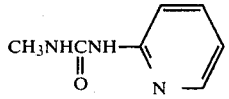

(5)-5 $CH_3NHC(=O)NHCH_2CH_2OH$ (5)-6 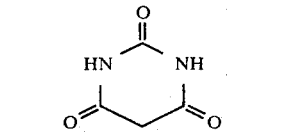

(5)-7 $HOCH_2CH_2NHC(=O)NHCH_2CH_2OH$ (5)-8 $CH_3NHC(=O)NHCH_2CH_2OCH_3$ (5)-9 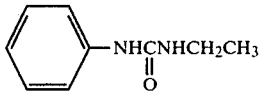

(5)-10 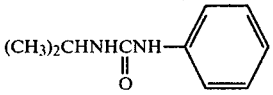

(5)-11 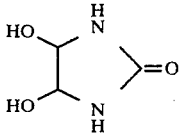

(5)-12 $HOCH_2NH-C(=O)-NHCH_2OH$ (5)-13 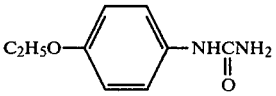

(5)-14 $CH_2=CHCH_2NH-C(=O)-NHCH_2CH_2OH$ (5)-15 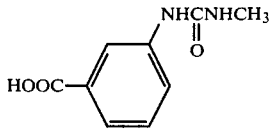

The compounds represented by the formulae (I) and (II) (Component (4)) and (III) (Component (5)) are known compounds, and can be synthesized by general methods described in S. R. Sandler & W. Karo, *Organic Functional Group Preparations* (translated by Inamoto & Takeuchi, *Syntheses of Organic compounds Classified by Functional Group,* Vol. I and Vol. II, Hirokawa Shoten, Tokyo (March 1976)), and can be purchased commercially as raw materials for general industrial use.

Organic acids employed for preparing organic acid-iron (III) complex salts which are preferably used as the bleaching agent Component (1) in the bleaching composition of the invention include ethylenediaminetetraacetic acid, diethylenetriaminepentaacetic acid, nitrilotriacetic acid, propylenediaminetetraacetic acid, cyclohexanediaminetetraacetic acid and the like, and the above-described bleaching agent can be effectively used in an amount from about 0.05 to 2 mols, and more preferably from 0.1 to 0.5 mol, per liter of bleaching solution.

In the bleaching composition of the invention, bromates such as potassium bromate, sodium bromate, ammonium bromate and the like can be used as Component (2). A preferred content of the bromate is from about 0.005 to 0.5 mol, and more preferably is from 0.05 to 0.3 mol, per liter of bleaching solution.

The water soluble halogenide used in the bleaching composition of this invention as Component (3) is an alkali metal (such as sodium, potassium etc.) or ammonium salt of halogenide, for example, sodium chloride, potassium chloride, ammonium chloride, sodium bromide, potassium bromide, ammonium bromide etc. The content of the water soluble halogenide is not specifically limited but preferably from about 0.1 to 7 mols, more preferably from 0.5 to 4 mols, and most preferably from 1 to 3 mols, per liter of bleaching solution.

In addition, one or more of an inorganic acid or the salt thereof which has the buffer capacity with regard to pH, with specific examples including boric acid, borax, sodium metaborate, acetic acid, sodium acetate, sodium carbonate, potassium carbonate, phosphorous acid, phosphoric acid, sodium phosphate and the like, can be further added to the bleaching solution. Moreover, salts such as sodium sulfate, potassium sulfate and the like can be added to the bleaching solution in order to control the salt concentration.

Furthermore, in the processing according to an embodiment of the present invention, various kinds of bleaching accelerators can be used in combination with the above-described bleaching agents. Suitable examples of the bleaching accelerator include mercapto compounds and dithiocarbamate compounds which are described in U.S. Pat. Nos. 3,707,374, 3,772,020 and 3,893,858, Japanese Patent Publication No. 28227/76, Japense Patent Application (OPI) Nos. 94927/78 (the term "OPI" as used herein refers to a "published unexamined Japanese patent application"), 95631/78, 25064/80 and 26506/80 and *Research Disclosure,* 15704 (May, 1977).

Specifically, compounds containing mercapto groups represented by the following formula (IV) (and precursors thereof) are preferred as the above-described bleaching accelerator:

$$Y\text{-}A\text{-}SH \qquad (IV)$$

wherein A represents an alkylene group or a nitrogen-containing hetero-ring, and Y represents an alkyl-substituted or a non-substituted amino group, a nitrogen-containing saturated hetero-ring, hydroxy group, carboxy group or sulfo group.

More particularly, compounds represented by the following formula (V) (and precursors thereof) are more preferred:

$$Y\text{-}(CH_2)_m\text{-}SH \qquad (V)$$

wherein Y represents N,N-dimethylamino group, N,N-diethylamino group, hydroxy group or sulfo group; and m represents an integer of 2 or 3.

Preferred examples of compounds represented by formulae (IV) and (V), and precursor thereof, are illustrated below:

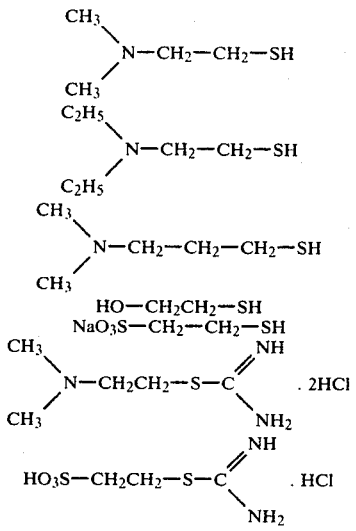

The above-described bleaching accelerator may be added to not only a bleaching bath containing composition of this invention, but also a processing bath to be used in or after the step of color development and before the step of bleach; for example, a color developing bath, a mere water bath, a stop bath, a stop-fixed bath or so on. Bleaching accelerator to be added can conveniently range from about $4\times10^{-5}$ to $5\times10^{-1}$ mol, and more preferably from $4\times10^{-3}$ to $1\times10^{-1}$ mol, per liter of solution to which the accelerator is added.

In a process for preparing a bleaching solution using the bleaching composition of the present invention, an aqueous solution containing all components except Component (3) is first prepared, and Component (3) can be immediately added thereto in the form of solid or aqueous solution. Alternatively, after preparation of an aqueous solution containing all components except Component (1), Component (1) may be finally added to the aqueous solution in a form of solid or aqueous solution.

It is desirable to adjust the pH of the bleaching solution to a value within the range of from about 3.5 to 7.0, and more preferably to from 4.0 to 6.0, at the time of use.

In carrying out the processing of a sensitive material containing couplers using the bleaching composition of the present invention, either four-equivalent couplers or two-equivalent ones may be employed therein as the couplers. In addition, at least some of these couplers may be colored couplers for color correction, non-colored couplers, or couplers capable of releasing development inhibitors as development proceeds (the so-called DIR couplers).

As yellow color-forming couplers, open-chain ketomethylene series couplers can be employed. Of these couplers, benzoyl acetoanilide series compounds and pivaloyl acetoanilide series compounds are of greater advantage. Specific examples of such yellow color-forming couplers are described in U.S. Pat. Nos. 2,875,057, 3,265,506, 3,408,194, 3,551,155, 3,582,322, 3,725,072 and 3,894,875, German Patent Publication No. 1,547,868, German Patent Application (OLS) Nos. 2,213,461, 2,219,917, 2,261,361, 2,263,875 and 2,414,006 and so on.

As magenta color-forming couplers, 5-pyrazolone series compounds are mainly employed, but indazolone series compounds and cyanoacetyl compounds may be also used. Specific examples of them are described in U.S. Pat. Nos. 2,600,788, 2,983,608, 3,062,653, 3,127,269, 3,311,476, 3,419,391, 3,476,560, 3,519,429, 3,558,319, 3,582,322 and 3,615,506, German Patent Publication No. 1,810,464, German Patent Application (OLS) Nos. 2,408,665, 2,418,959 and 2,424,467, Japanese Patent Publication Nos. 6031/65 and 2016/69, and so on.

As cyan color-forming couplers, phenol or naphthol derivatives are mainly employed. Specific examples of them are described in U.S. Pat. Nos. 2,369,929, 2,434,272, 2,474,293, 2,521,908, 2,895,826, 3,034,892, 3,311,476, 3,386,830, 3,458,315, 3,476,563, 3,583,971 and 3,591,383 and Japanese Patent Application (OPI) No. 78905/73.

In addition, specific examples of DIR couplers and other "development inhibiting compound-releasing compounds" are described in U.S. Pat. Nos. 3,227,554, 3,617,291, 3,632,345, 3,701,783 and 3,790,384, British Pat. No. 953,454, German Patent Application (OLS) Nos. 2,414,006, 2,417,914, 2,417,945, 2,454,301 and 2,454,329, U.S. Pat. Nos. 3,297,445 and 3,379,529 and so on.

Moreover, couplers described in Japanese Patent Application (OPI) Nos. 102636/76, 26541/76, 159336/75, 20826/76 and 26034/76, and Japanese Patent Application Nos. 114445/74, 1792/75, 70592/75, 96435/76, 118029/75 and 118540/75 can be also used.

As for the above-described couplers, two or more of the couplers can be used in combination in the same layer in order to satisfy characteristics required for the sensitive material, or the same coupler may, of course, be added to two or more different layers.

These couplers are, in general, dispersed into silver halide photographic emulsion layers together with solvents having proper magnitudes of polarities. Useful solvents therefor are, for example, tri-o-cresyl phosphate, trihexyl phosphate, dioctyl butyl phosphate, dibutyl phthalate, diethyllaurylamide, 2,4-diallylphenol, octylbenzoate and so on.

The representatives of color image-forming materials used in sensitive materials for the silver dye bleach process, which can be processed using the bleaching composition of the present invention, are azo dyes.

A color sensitive material capable of being subjected to the photographic processing according to the method of the present invention is that which has at least one silver halide emulsion layer on a support and generally, that which has on a support a red-sensitive silver halide emulsion layer, a green-sensitive silver halide emulsion layer and a blue-sensitive silver halide emulsion layer. Described in greater detail, it has, in general, on a support, at least one red-sensitive silver halide emulsion layer containing a cyan image-forming coupler, at least one green-sensitive silver halide emulsion layer containing a magenta image-forming coupler, and at least one blue-sensitive silver halide emulsion layer containing a yellow image-forming coupler. Such a photographic element may have light-insensitive photographic layers (for example, an antihalation layer, an interlayer for the prevention of color mixing, a yellow filter layer, a protecting layer and so on). In addition, any particular restrictions are not imposed on sequence of the above-described light-sensitive emulsion layers. As the silver halide photographic emulsions, either those which form latent image at the surface of the grains to a very appreciable extent or those which form latent image inside the grains and substantially no latent image on the surface of the grains, which can be prepared in conventional known processes, can be employed.

As described in detail above, sensitive materials can be used in the present invention without receiving any particular restrictions on the process of preparing silver halide emulsions to be contained therein, the layer construction thereof, the photographic additives to be added thereto, the raw materials therefor and the photographic processing solutions to be used therefor.

The present invention can be applied to the processing of all color sensitive materials in which silver halides are employed, such as color paper, color negative film, color reversal film, color positive film and so on. However, the present invention can exhibit greater effects when applied to the processing of such sensitive materials that the total amount of silver contained in the silver halide emulsion layers is 30 mg or more per 100 $cm^2$ of the sensitive material. Especially, the present invention is advantageous in using for the processing of the sensitive material containing silver in a total amount of at least 40 mg/100 $cm^2$.

A process for processing color negative film, color positive film, color paper or the like, which each is subjected to imagewise exposure in advance, using the bleaching composition of the present invention includes generally several steps as described below. Basic examples of the sequence of the steps of such processes are illustrated below:

(P1) Color development→Stop→Bleaching→Washing→Fixing→Washing→Stabilizing→Drying.

(P2) Color development→Stop→Bleaching→Fixing→Washing→Stabilizing→Drying.

(P3) Color development→Stop-Fixing→Bleaching→Fixing→Washing→Stabilizing→Drying.

In each of processes (P1) to (P3), a prebath, a hardening bath and so on may be additionally provided before the step of color development, and the step of washing to be carried out after the stabilizing or the bleaching step may be omitted.

On the other hand, the processing of reversal color film usually comprises steps indicated in processes (P4) or (P5) below:

(P4) Black-and-white development→Stop→Washing→Fogging→Washing→Color development→Stop→Washing→Bleaching→Washing→Fixing→Washing→Stabilizing→Drying.

(P5) Black-and-white development→Stop→Washing→Fogging→Washing→Color development→Stop→Washing→Bleaching→Fixing→Washing→Stabilizing→Drying.

In each process (P4) or (P5), a prebath, a prehardening bath, a neutralizing bath and so on can be additionally provided, and washing after stabilizing or bleaching can be omitted. A fogging bath can be replaced by reexposure or omitted by adding a fogging agent to the color developer.

The processes illustrated in the above clauses (P1) to (P5) are useful in the photographic processing method of the present invention. However, the invention is not intended to be construed as being limited to these processes.

EXAMPLE

On a polyethylene terephthalate film support having a subbing layer, were coated the emulsions described below in this order.

The first layer (red-sensitive emulsion layer)

To a 1,000 g portion of silver iodobromide emulsion (containing 5 mol% of silver iodide, 10 wt% of silver halide and 5 wt% of gelatin), were added a 500 g of gelatin solution wherein cyan coupler (C-1) was emulsified and dispersed (silver:coupler=7:1 (by mol)), a 50 ml of 1% aqueous solution of stabilizer (A-1), a 50 ml of 1% aqueous solution of coating agent (T-1) and a 20 ml of 2% aqueous solution of hardening agent (H-1). The resulting emulsion was coated on the support so as to have a dry thickness of 4μ.

The second layer (interlayer)

To a 1,000 g portion of 5% aqueous solution of gelatin were added a 100 g of gelatin aqueous solution wherein color mixing inhibitor (A-2) was emulsified and dispersed, a 50 ml of 1% aqueous solution of coating agent (T-1) and a 20 ml of 2% aqueous solution of hardening agent (H-1). The resulting gelatin solution was coated on the first layer so as to have a dry thickness of 1μ.

The third layer (green-sensitive emulsion layer)

To a 1,000 g portion of silver iodobromide emulsion (containing 5 mol% of silver iodide, 10 wt% of silver halide and 5 wt% of gelatin) were added a 700 g of gelatin solution wherein magenta coupler (C-2) was emulsified and dispersed (silver:coupler=7:1 (by mol)), a 50 ml of 1% aqueous solution of stabilizing agent (A-1), a 50 ml of 1% aqueous solution of coating agent (T-1) and a 20 ml of 2% aqueous solution of hardening agent (H-1). The resulting emulsion was coated on the second layer so as to have a dry thickness of 4μ.

The fourth layer (yellow filter layer)

To a 1,000 g portion of 5% gelatin aqueous solution into which colloidal silver was dispersed, were added a 100 ml of 1% aqueous solution of coating agent (T-1) and a 20 ml of 2% aqueous solution of hardening agent (H-1). The resulting solution was coated at the coverage of 0.5 mg silver per 100 $cm^2$.

The fifth layer (blue-sensitive emulsion layer)

To a 1,000 g portion of silver iodobromide emulsion (containing 5 mol% of silver iodide, 10 wt% of silver halide and 5 wt% of gelatin) were added a 500 g of gelatin solution wherein yellow coupler (C-3) was emulsified and dispersed (silver:coupler=7:1 (by mol)), a 50 ml of 1% aqueous solution of stabilizing agent (A-1), a 50 ml of 1% aqueous solution of coating agent (T-1) and a 20 ml of 2% aqueous solution of hardening agent (H-1). The resulting emulsion was coated on the fourth layer so as to have a dry thickness of 4μ.

The sixth layer (protective layer)

To a 1,000 g portion of 5% aqueous solution of gelatin were added a 100 ml of 1% aqueous solution of coating agent (T-1) and a 20 ml of 1% aqueous solution of hardening agent (H-1). The resulting gelatin solution was coated on the fifth layer so as to have a dry thickness of 1μ.

C-1

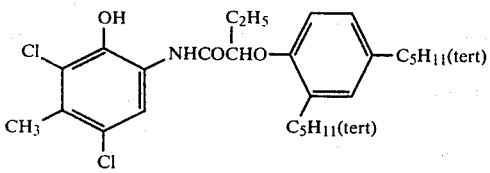

Emulsifying Process: To a mixed solution of 100 ml of dibutyl phthalate and 200 ml of ethyl acetate, was dissolved 75 g of cyan coupler (C-1) at 50° C. The resulting solution was added into a 1000 ml of 10 wt% aqueous solution of gelatin containing 5 g of sodium p-dodecylbenzene sulfonate and the resulting mixture was vigorously stirred for 20 minutes using a high speed agitator to emulsify and disperse the cyan coupler (C-1) together with the solvents.

C-2

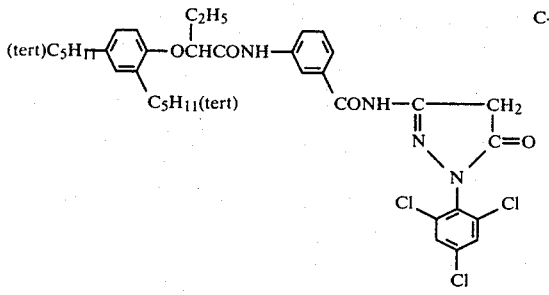

Emulsifying Process: Magenta coupler (C-2) was emulsified in the same manner as described in emulsification of cyan coupler (C-1) except that 75 g of magenta coupler (C-2) was dissolved instead of cyan coupler (C-1).

C-3

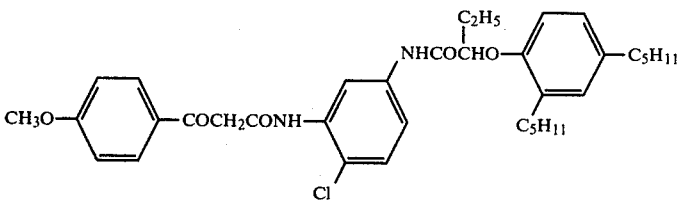

Emulsifying Process: Yellow coupler (C-3) was emulsified in the same manner as described in emulsification of cyan coupler (C-1) except that 90 g of yellow coupler (C-3) was dissolved instead of cyan coupler (C-1).

A-1

A-2

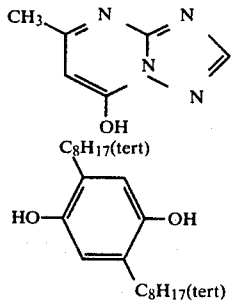

Emulsifying Process: To a mixed solution of 200 ml of dibutyl phthalate and 200 ml of ethyl acetate was dissolved 100 g of color mixing inhibitor (A-2). The resulting solution was added into a 1000 ml of 10 wt% aqueous solution of gelatin containing 5 g of sodium p-dodecylbenzene sulfonate and the resulting mixture was vigorously stirred for 20 minutes using a high speed agitator to emulsify and disperse the color mixing inhibitor (A-2) together with the solvents.

T-1

H-1

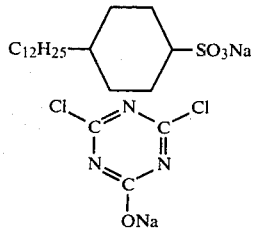

The thus-obtained reversal color film was exposed to light through an optical wedge, and development-processed in the following processing process.

On this occasion, as a bleaching bath, a bleaching solution of the present invention was prepared which contained all ingredients corresponding to Components (1), (2), (3), (4) and (5), and three kinds of comparison solutions were prepared: namely, Comparison 1, which contained only three ingredients, corresponding to Components (1), (2), and (3), and lacked ingredients corresponding to Components (4) and (5); Comparison 2, which contained four components, and lacked only an ingredient corresponding to Component (5); and Comparison 3 which contained the same number of ingredients as the Comparison 2 but which differed in that it lacked an ingredient corresponding to Component (4) rather than Component (5). After preparation, each of these solutions was divided into two portions. One was immediately used for the bleaching processing, and the other was used for the same purpose after receiving an aging treatment at 40° C. for 5 days.

| Processing Step | Processing Temperature (°C.) | Processing Time |
|---|---|---|
| First development | 43 | 2 min |
| First stop | 40 | 20 sec |
| Washing | 40 | 40 sec |
| Second development | 46 | 2 min 15 sec |
| Prebath | 40 | 15 sec |
| Washing | 40 | 5 sec |
| Bleaching | 40 | 45 sec |
| Fixing | 40 | 40 sec |
| Washing | 40 | 25 sec |
| Stabilizing | 40 | 20 sec |

First Developer

| | | |
|---|---|---|
| Water | 800 | ml |
| Quadrafos | 2.0 | g |
| Anhydrous Sodium Hydrogensulfite | 8.00 | g |
| Phenidone | 0.35 | g |

-continued

| | | |
|---|---|---|
| Anhydrous Sodium Sulfite | 37.0 | g |
| Hydroquinone | 5.50 | g |
| Anhydrous Sodium Carbonate | 28.2 | g |
| Sodium Thiocyanate | 1.38 | g |
| Sodium Bromide | 1.30 | g |
| Potassium Iodide (0.1% solution) | 13.0 | ml |
| Water to make | 1.00 | l |
| pH | 9.90 | |

First Stop Solution

| | | |
|---|---|---|
| Water | 800 | ml |
| Glacial Acetic Acid | 30.0 | ml |
| Sodium Hydroxide | 1.65 | g |
| Water to make | 1.00 | l |
| pH | 3.50 | |

Second Developer (color developer)

| | | |
|---|---|---|
| Water | 800 | ml |
| Sodium Hexametaphosphate | 5.0 | g |
| Benzyl Alcohol | 4.50 | ml |
| Anhydrous Sodium Sulfite | 7.50 | g |
| Sodium Tertiary Phosphate ($12H_2O$) | 36.0 | g |
| Sodium Bromide | 0.90 | g |
| Potassium Iodide (0.1% solution) | 90 | ml |
| Sodium Hydroxide | 3.25 | g |
| Citrazinic Acid | 1.50 | g |
| N-Ethyl-N-β-methanesulfonamidoethyl-3-methyl-4-aminoaniline Sesquisulfate Monohydrate | 11.0 | g |
| Ethylenediamine | 3.00 | g |
| tert-Butylamineborane | 0.07 | g |
| Water to make | 1.00 | l |
| pH | 11.65 | |

Prebath

| | | |
|---|---|---|
| Water | 800 | ml |
| Glacial Acetic Acid | 10 | ml |
| Anhydrous Sodium Sulfite | 12 | g |
| 2-N,N-Dimethylaminoethylthiuronium-chloride Hydrochloride | 4.4 | g |
| Water to make | 1 | l |
| pH | 3.5 | |

Bleaching Solution

| | | |
|---|---|---|
| Water | 800 | ml |
| Disodium Ethylenediaminetetraacetate ($2H_2O$) | 10 | g |
| Ammonium Ethylenediaminetetraacetato-ferrate (III) ($2H_2O$) [Component (1)] | 170 | g |
| Ammonium Chloride [Component (3)] | 150 | g |
| Potassium Borate [Component (2)] | 5 | g |
| Component (4) | set forth in Table 1 | |
| Component (5) | set forth in Table 1 | |
| Water to make | 1 | l |

Fixing Solution

-continued

| | | |
|---|---|---|
| Water | 400 | ml |
| Ammonium Thiosulfate (58%) | 169 | ml |
| Anhydrous Sodium Sulfite | 11.5 | g |
| Disodium Ethylenediaminetetraacetate ($2H_2O$) | 0.5 | g |
| Anhydrous Sodium Acetate | 12 | g |
| Glacial Acetic Acid | 9 | ml |
| Water to make | 1 | l |
| pH | 5.5 | |

Stabilizing Bath

| | | |
|---|---|---|
| Water | 800 | ml |
| Formalin (37.5%) | 6 | ml |
| Water to make | 1 | l |

Specific examples of Components (4) and (5), respectively, contained in the bleaching bath, additional amounts thereof, and the results obtained are shown in Table 1.

As can be seen from Table 1, both magenta stain and yellow stain increased with the lapse of time in the bleaching solution to which neither Component (4) nor (5) were added. In the case of bleaching solutions to which only Component (4) was added, the increase of magenta stain was reduced, but the increase of yellow stain was not reduced, while in the case of a bleaching solution to which only Component (5) was added, the increase of yellow stains was reduced, the increase of magenta stain was not reduced. On the other hand, in the bleaching solution containing both Components (4) and (5) according to the embodiment of this invention, the increase of magenta stain and that of yellow stain were both reduced.

TABLE 1

| | | Condition of Bleaching Solution | | | | Increment* of Stain after Aging | |
|---|---|---|---|---|---|---|---|
| | | Component (4) | | Component (5) | | | |
| Experiment No. | | Name | Amount Added (g/l) | Name | Amount Added (g/l) | Magenta Stain | Yellow Stain |
| 1 | Comparison | None | 0 | None | 0 | 0.09 | 0.07 |
| 2 | Comparison | (4)-2 | 2.3 | None | 0 | 0.01 | 0.07 |
| 3 | Comparison | (4)-1 | 3.6 | None | 0 | 0.06 | 0.07 |
| 4 | Comparison | (4)-8 | 6.0 | None | 0 | 0.05 | 0.07 |
| 5 | Comparison | (4)-17 | 2.2 | None | 0 | 0.01 | 0.07 |
| 6 | Comparison | (4)-9 | 3.3 | None | 0 | 0.01 | 0.07 |
| 7 | Comparison | None | 0 | (5)-1 | 3.0 | 0.08 | 0.00 |
| 8 | Comparison | None | 0 | (5)-2 | 8.0 | 0.09 | 0.02 |
| 9 | Comparison | None | 0 | (5)-6 | 5.0 | 0.08 | 0.04 |
| 10 | Invention | (4)-17 | 2.2 | (5)-1 | 3.0 | 0.02 | 0.00 |
| 11 | Invention | (4)-9 | 3.3 | (5)-1 | 3.0 | 0.04 | 0.01 |

*Increment: Stain caused by the use of the solution aged at 40° C. for 5 days minus stain caused by the use of fresh solution.

While the invention has been described in detail and with reference to specific embodiments thereof, it will be apparent to one skilled in the art that various changes and modifications can be made therein without departing from the spirit and scope thereof.

What is claimed is:

1. A bleaching composition for the photographic processing of silver halide color photosensitive materials containing Components:

(1) an organic acid-iron (III) complex salt;

(2) an alkali metal or ammonium salt of bromic acid;

(3) a water-soluble halogenide;

(4) at least one compound selected from the group consisting of compounds represented by the formula (I) or (II)

$$X\text{-}(R^1)_m COOM \quad (I)$$

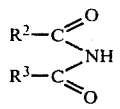

(II)

wherein X represents COOM or amino group, with M representing hydrogen, an alkali metal ion or an ammonium ion; $R^1$ represents a divalent aliphatic group containing from 1 to 4 carbon atoms which may be substituted with hydroxy groups, amino groups, and/or carboxy groups; n is 0 or 1; and $R^2$ and $R^3$ may be the same or different from each other, and each represents an amino group, an acylamino group, an alkyl group, an alkenyl group, a phenyl group, or a 5-membered or a 6-membered heterocyclic group, or $R^2$ and $R^3$ together form a 5-membered or a 6-membered ring; and (5) at least one compound selected from the group consisting of compounds represented by the formula (III)

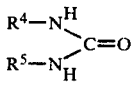

(III)

wherein $R^4$ and $R^5$ may be the same or different from each other, and each represents an alkyl group, an alkenyl group, a phenyl group, or a 5-membered or a 6-membered heterocyclic group, or $R^4$ and $R^5$ together form a 5-membered or a 6-membered ring.

2. A bleaching composition as in claim 1, wherein Component (4) is a compound represented by the formula (II).

3. A bleaching composition as in claim 1, wherein Component (4) is a compound wherein $R^2$ and $R^3$ together form a 5-membered or a 6-membered ring.

4. A bleaching composition as in claim 1, wherein said Component (4) is succinimide.

5. A bleaching composition as in claim 1, wherein Component (1) is an ethylenediaminetetraacetatoferrate (III) complex salt, Component (2) is sodium or potassium bromate, Component (3) is a water-soluble chloride, Component (4) is succinimide or a derivative thereof, and Component (5) is ethylene urea.

6. A bleaching composition as in claim 1, wherein when $R^2$ and $R^3$ is an alkyl group, said alkyl group comprises from 1 to 4 carbon atoms.

7. A bleaching composition as in claim 1 or 6, wherein when $R^2$ or $R^3$ is an alkenyl group, said alkenyl group comprises from 2 to 5 carbon atoms.

8. A bleaching composition as in claim 1, wherein when $R^4$ or $R^5$ is an alkyl group, said alkyl group comprises from 1 to 4 carbon atoms.

9. A bleaching composition as in claim 1 or 8, wherein when $R^4$ or $R^5$ is an alkenyl group, said alkenyl group comprises from 2 to 5 carbon atoms.

10. A bleaching composition as in claim 1, 2, 3, 4, or 5, wherein Components (4) and (5) are each present in amounts within a range from about 0.005 to 0.5 mol per liter of bleaching composition.

11. A bleaching composition as in claim 1, 2, 3, 4, or 5, wherein Components (4) and (5) are each present in an amount within a range from 0.01 to 0.3 mol per liter of bleaching composition.

12. A bleaching composition as in claim 1, wherein Component (1) is present in an amount from about 0.05 to 2 mols per liter of bleaching composition.

13. A bleaching composition as in claim 1, wherein Component (1) is present in an amount within a range from 0.1 to 0.5 mol per liter of bleaching composition.

14. A bleaching composition as in claim 1, wherein Component (2) is present in an amount from about 0.005 to 0.5 mol per liter of bleaching composition.

15. A bleaching composition as in claim 1, wherein Component (2) is present in an amount within a range from 0.05 to 0.3 mol per liter of bleaching composition.

16. A bleaching composition as in claim 1, wherein Component (3) is present in an amount from about 0.1 to 7 mols per liter of bleaching composition.

17. A bleaching composition as in claim 1, wherein Component (3) is present in an amount within a range from 0.5 to 4 mols per liter of bleaching composition.

18. A bleaching composition as in claim 1, wherein Component (3) is present in an amount within a range from 1 to 3 mols per liter of bleaching composition.

19. A bleaching composition as in claim 1, 2, 3, 4, or 5, wherein a bleaching accelerator represented by the formula (IV)

Y-A-SH (IV)

wherein A represents an alkylene group or a nitrogen-containing hetero-ring, and Y represents an alkyl-substituted or a non-substituted amino group, a nitrogen-containing saturated hetero-ring, a hydroxy group, a carboxy group or a sulfo group, is contained therein.

20. A bleaching composition as in claim 1, 2, 3, 4, or 5, wherein a bleaching accelerator represented by the formula (V)

$Y\text{-}(CH_2)_m\text{-}SH$ (V)

wherein Y represents N,N-dimethylamino group, N,N-diethylamino group, hydroxy group or sulfo group; and m represents an integer of 2 or 3, is contained therein.

21. A bleaching composition as in claim 19, wherein the bleaching accelerator is contained in an amount ranging from about $4\times10^{-5}$ to $5\times10^{-1}$ mol per liter of bleaching composition.

22. A bleaching composition as in claim 20, wherein the bleaching accelerator is contained in an amount ranging from about $4\times10^{-5}$ to $5\times10^{-1}$ mol per liter of bleaching composition.

23. A bleaching composition as in claim 19, wherein the bleaching accelerator is contained in an amount ranging from about $4\times10^{-3}$ to $1\times10^{-1}$ mol per liter of bleaching composition.

24. A bleaching composition as in claim 20, wherein the bleaching accelerator is contained in an amount ranging from about $4\times10^{-3}$ to $1\times10^{-1}$ mol per liter of bleaching composition.

25. A method for processing color photographic light-sensitive materials including a bleaching step, wherein the bleaching step is carried out using a bleaching composition containing Components:

(1) an organic acid-iron(III) complex salt;
(2) an alkali metal or ammonium salt of bromic acid;
(3) a water soluble halogenide;
(4) at least one compound selected from the group consisting of compounds represented by the formula (I) or (II)

$$X\text{-}(R^1)_n COOM \quad (I)$$

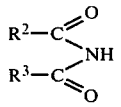

(II)

wherein X represents COOM or amino group, with M representing hydrogen, an alkali metal ion or an ammonium ion; $R^1$ represents a divalent aliphatic group containing from 1 to 4 carbon atoms which may be substituted with hydroxy groups, amino groups and/or carboxy groups; n is 0 or 1; and $R^2$ and $R^3$ may be the same or different from each other, and each represents an amino group, an acylamino group, an alkyl group, an alkenyl group, a phenyl group, or a 5-membered or a 6-membered heterocyclic group, or $R^2$ and $R^3$ together form a 5-membered or a 6-membered ring; and (5) at least one compound selected from the group consisting of compounds represented by the formula (III)

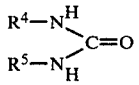

(III)

wherein $R^4$ and $R^5$ may be the same or different from each other, and each represents an alkyl group, an alkenyl group, a phenyl group, or a 5-membered or a 6-membered heterocyclic group, or $R^4$ and $R^5$ together form a 5-membered or a 6-membered ring.

26. A method as in claim 25, wherein a bleaching accelerator represented by the formula (IV)

$$Y\text{-}A\text{-}SH \quad (IV)$$

wherein A represents an alkylene group or a nitrogen-containing hetero-ring, and Y represents an alkyl-substituted or a non-substituted amino group, a nitrogen-containing saturated hetero-ring, a hydroxy group, a carboxy group or a sulfo group, is added to a processing bath to be used in or after a color development step and prior to the bleaching step.

27. A method as in claim 25, wherein a bleaching accelerator represented by the formula (IV)

$$Y\text{-}A\text{-}SH \quad (IV)$$

wherein A represents an alkylene group or a nitrogen-containing hetero-ring, and Y represents an alkyl-substituted or a non-substituted amino group, a nitrogen-containing saturated hetero-ring, a hydroxy group, a carboxy group or a sulfo group, is added to the bleaching composition.

28. A method as in claim 26, wherein the processing bath is a color developing bath, a mere water bath, a stop bath or a stop-fixing bath.

* * * * *